US005332156A

United States Patent [19]

Wheeler

[11] Patent Number: 5,332,156

[45] Date of Patent: Jul. 26, 1994

[54] SPRAY GUN WITH REMOVABLE COVER AND METHOD FOR SECURING A COVER TO A SPRAY GUN

[75] Inventor: Roger D. Wheeler, Holland, Ohio

[73] Assignee: Ransburg Corporation, Indianapolis, Ind.

[21] Appl. No.: 142,825

[22] Filed: Oct. 25, 1993

[51] Int. Cl.[5] ..... B25F 5/02

[52] U.S. Cl. ..... 239/288; 239/526; 239/600; 173/170

[58] Field of Search ..... 239/288, 525–528, 239/530, 600; 81/54, 177.1, 487, 489, 492; 173/170; 227/156; 24/20 S, 20 R, 283; 403/344, 373, DIG. 9

[56] References Cited

U.S. PATENT DOCUMENTS

| | | | |
|---|---|---|---|
| 2,629,908 | 3/1953 | Keck | 24/20.5 |
| 3,159.047 | 12/1964 | Dable | 403/344 |
| 3,799,447 | 3/1974 | Beal | 239/526 |
| 3,846,033 | 11/1974 | Smollinger | 403/344 |
| 4,286,734 | 9/1981 | Tonge | 239/526 |
| 4,294,411 | 10/1981 | Hastings et al. | 239/528 |
| 4,651,929 | 3/1987 | Kränzle | 239/526 |
| 4,700,876 | 10/1987 | Wingert | 227/156 |
| 4,706,598 | 11/1987 | Jeffress | 403/344 |
| 4,776,517 | 10/1988 | Heren | 239/526 |
| 4,915,303 | 4/1990 | Hufgard | 239/526 |
| 5,139,358 | 8/1992 | Kodama et al. | 403/344 |
| 5,143,299 | 9/1992 | Simonetti et al. | 239/526 |

FOREIGN PATENT DOCUMENTS

| | | | |
|---|---|---|---|
| 3300290 | 7/1984 | Fed. Rep. of Germany | 239/526 |
| 4007880 | 8/1991 | Fed. Rep. of Germany | 239/526 |

*Primary Examiner*—Karen B. Merritt

*Attorney, Agent, or Firm*—MacMillan, Sobanski & Todd

[57] ABSTRACT

A removable cover for a paint spray gun and similar tools. The cover is formed into two halves which enclose opposite sides of the gun. A tab on the front of each cover half is retained in a notch in the gun. Rear ends of the cover halves are releasable secured together by a first spring clip positioned in aligned grooves in the cover halves. Ends of the cover halves which extend over a gun handle are releasable secured together by a second spring clip positioned in aligned grooves in the cover halves.

15 Claims, 3 Drawing Sheets

SPRAY GUN WITH REMOVABLE COVER AND METHOD FOR SECURING A COVER TO A SPRAY GUN

TECHNICAL FIELD

The invention relates to a body and handle cover for a gun shaped tool and more particularly to a removable cover for a spray gun and to a method for securing the cover to a spray gun frame.

BACKGROUND ART

Paint spray guns are most commonly provided with a solid metal body and an integral handle which are bored out to form paint and air passages and chambers for a triggering mechanism and for seals. During use, paint may accumulate on the exterior of the gun. Cleaning the exterior of the gun may necessitate submersion of the entire gun in solvent. It may be necessary to partially disassemble the gun to remove trapped solvent after cleaning. Some spray guns are provided with a plastic cover which encloses a frame including a body, a handle and a portion of the trigger mechanism. The cover is secured with screws set into recessed cavities in the cover. The cover can be removed from the frame to facilitate cleaning. Once removed, the cover is easily cleaned without having to submerge the entire gun in solvent and, once cleaned, the cover is easily dried. Removing a number of screws may be time consuming and there is a risk that the small screws will be lost. On spray guns and other tools, ease of cleaning and servicing with a minimum of tools is a valued product feature.

Providing a removable cover on a hand tool has an additional advantage. Tools are sometimes accidentally dropped or otherwise damaged during use. If the cover is damaged, it may be replaced. If the tool has no replaceable cover, it is necessary to construct the tool from stronger, heavier materials to reduce the risk of damage. This increases the weight of the tool which in turn increases operator fatigue during use.

DISCLOSURE OF INVENTION

The invention is directed to an improved removable cover for enclosing at least a portion of a frame of a gun shaped tool, such as a paint spray gun. As used herein, "frame" is intended to mean an upper body, a depending handle and any attached mechanism for operating the tool. The body portion of the frame has front and rear ends. The handle typically depends from adjacent a rear end of the body. The cover is formed into two halves for enclosing opposite sides of the frame. When the cover halves are positioned together, they form an enclosed chamber for receiving the frame and are shaped to provide clearance for any enclosed moving parts, such as a triggering mechanism. Each cover half has an upper front end which covers at least a portion of the front end of the gun body, an upper rear end which covers at least a portion of the rear end of the gun body and a handle portion which covers the gun handle and terminates at a lower end.

Tabs are provided on the upper front end of the cover halves for engaging a notch in the gun body or for engaging a member secured to the front end of the gun body. The tabs secure the upper front end of the cover halves relative to the gun body. After the cover halves are positioned over the frame with the tabs secured, an upper spring clip is expanded and positioned in a groove extending between the cover halves at least a portion of the circumference around the abutting rear ends of the cover halves. A lower spring clip is similarly expanded and positioned in a groove extending between the abutting cover halves around the lower ends of the cover halves. The tabs and the two spring clips releasably secure the cover halves to the gun frame. The cover halves are easily removed by hand from the gun by simply removing the two spring clips. Optionally, a small screwdriver may be used to facilitate expanding the two spring clips for removing or reattaching the spring clips. However, no special tools may be required to remove and reattach the cover.

Accordingly, it is an object of the invention to provide a removable cover for a gun shaped tool such as a paint spray gun.

Other objects and advantages of the invention will become apparent from the following detailed description of the invention and the accompanying drawings.

BEST MODES FOR CARRYING OUT THE INVENTION

Figure 1:
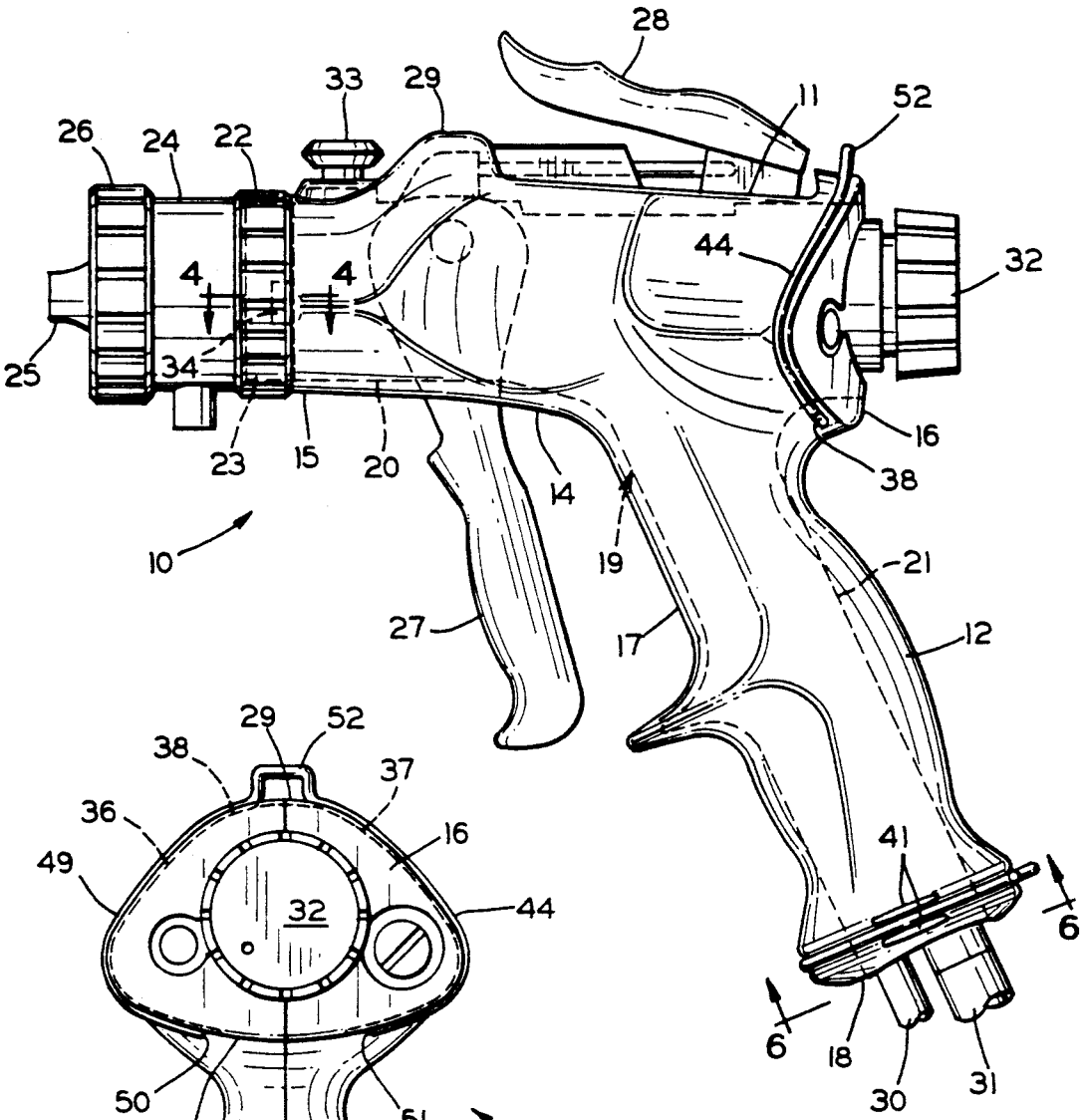
FIG. 1 is a side elevational view of a hand held paint spray gun having a cover according to the invention.
Figure 2:
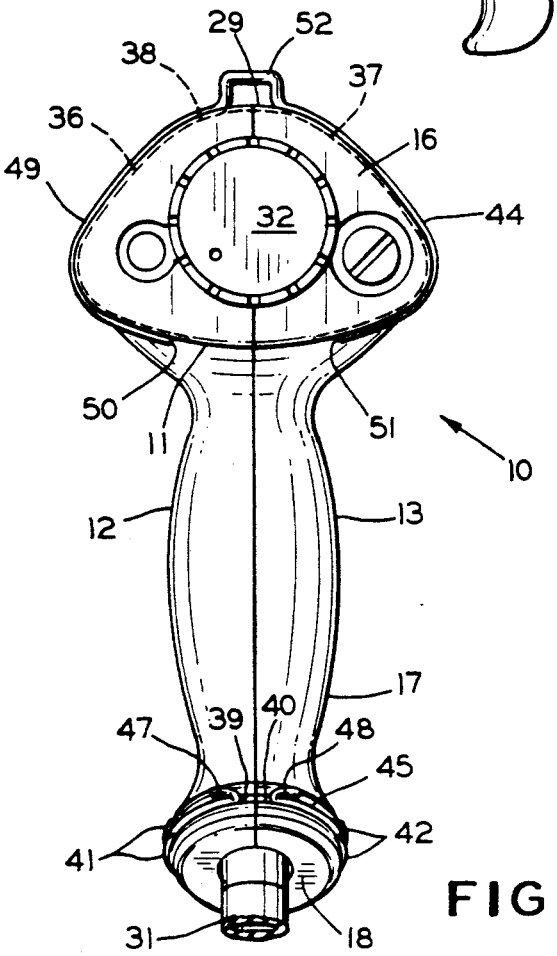
FIG. 2 is a rear elevational view of the spray gun of FIG. 1.

Referring to FIGS. 1 and 2 of the drawings, a spray gun 10 is illustrated embodying the invention. The spray gun 10 has an outer cover 11 formed from left and right halves 12 and 13, respectively. The cover 11 forms an upper body portion 14 having a front end 15 and a rear end 16 and a handle portion 17 having a lower free end 18. The cover 11 encloses a gun frame 19 which also includes a body 20 and a handle 21. An internally threaded retaining ring 22 is secured to rotate on a front end 23 of the frame body 20. A spray head 24 is releasably secured to the frame end 23 by the retaining ring 22 and an air cap 25 is secured to the spray head 24 by a retaining ring 26. A main trigger 27 is mounted on the frame body 20 to pivot towards and away from the handle portion 17. An optional auxiliary trigger 28 may be mounted on the frame body 20 adjacent the rear end 16 to pivot towards and away from a top 29 of the gun 10. The main trigger is used by an operator to control spraying when the operator grasps the handle portion 17. When spraying substantially horizontal surfaces, the operator may grasp the body portion 14 and use the auxiliary trigger 28 for controlling spraying.

Paint or other fluid to be sprayed is supplied to the gun 10 through a hose 30 connected to the lower handle end 18 and compressed air is supplied through a hose 31 connected to the lower handle end 18. The discharge of fluid and air from the spray gun is controlled by valves (not shown) which are actuated by either of the triggers 27 or 28. A control knob 32 extends from the rear end 16 of the cover 11 for setting the maximum fluid flow rate when the gun 10 is triggered fully on. At least a portion of the compressed air supplied through the hose 31 is used to atomized the fluid. A portion of the air also may be discharged from the air cap 25 for controlling the pattern of the atomized fluid between a round pattern and a flattened or fan shaped pattern. A knob 33 adjusts the flow of pattern shaping air to the air cap 25 to set the pattern in a known manner.

Figure 3:
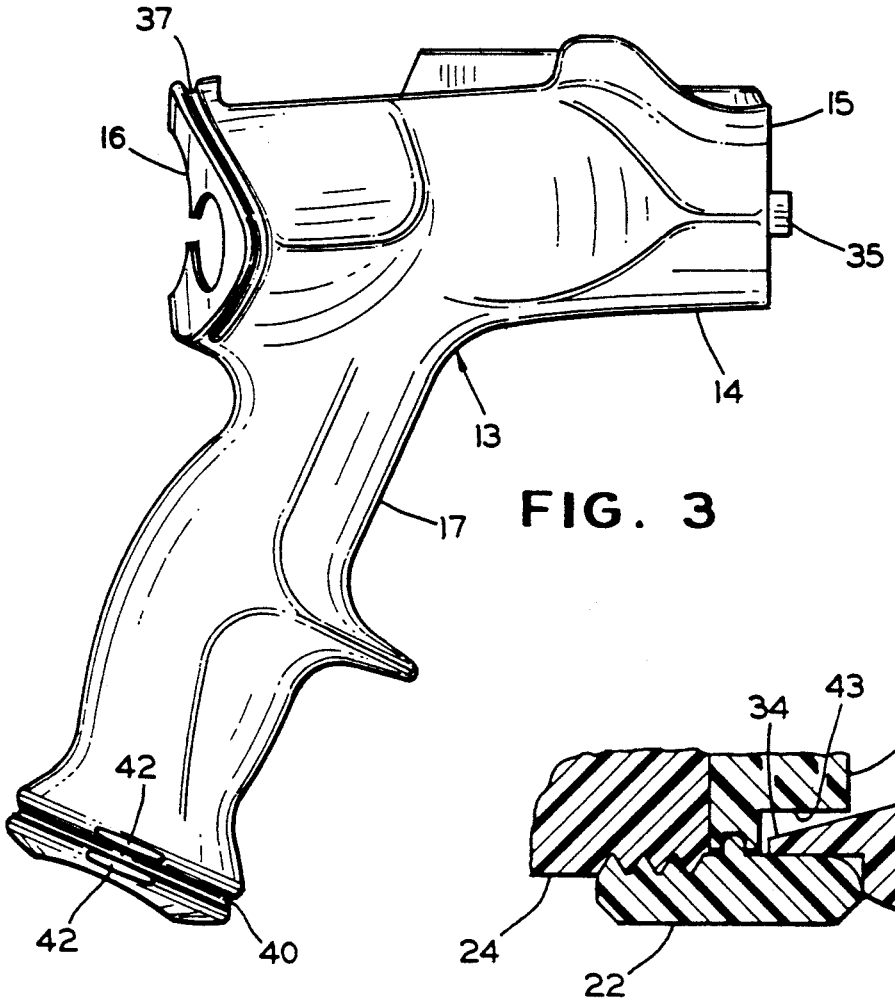
FIG. 3 is a side elevational view of the right cover half for the spray gun of FIG. 1.

The cover 11 consists of a left half 12 which encloses the left side of the frame 19 and a right half 13 which encloses the right side of the frame 19. Details of the left half 12 are shown in FIG. 1 and details of the right half are shown in FIG. 3. A tab 34 projects from the front end 15 of the half 12 and a tab 35 projects from the front end 15 of the half 13. A groove 36 is formed in the housing half 12 and a groove 37 is formed in the housing half 13. The grooves 36 and 37 each extend partially around the rear end 16. At the top 29 of the gun 10, the grooves 36 and 37 in the two halves 12 and 13 align when the halves 12 and 13 are abutting to form a single groove 38 which extends more than 180° around the rear end 16 of the cover 11. A groove 39 is formed in the housing half 12 and a corresponding groove 40 is formed in the housing half 13 adjacent the handle end 18. When the handle halves 12 and 13 are abutting, the grooves 39 and 40 connect to form a single groove extending completely around the handle 17 adjacent the end 18. A pair of raised ribs 41 may be provided on the cover half 12 on opposite sides of the groove 39 and a pair of raised ribs 42 may be provided on the cover half 13 on opposite sides of the groove 40.

Figure 4:
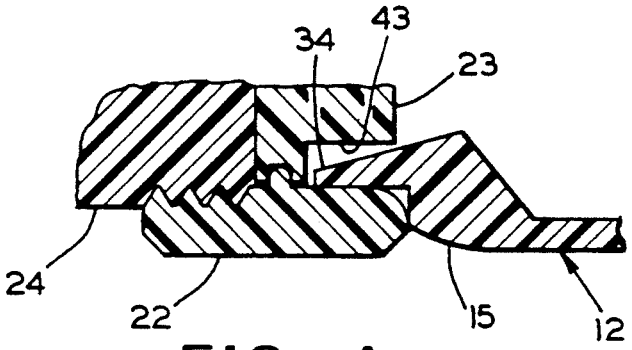
FIG. 4, is a fragmentary cross sectional view as taken along line 4—4 of FIG. 1.
Figure 6:
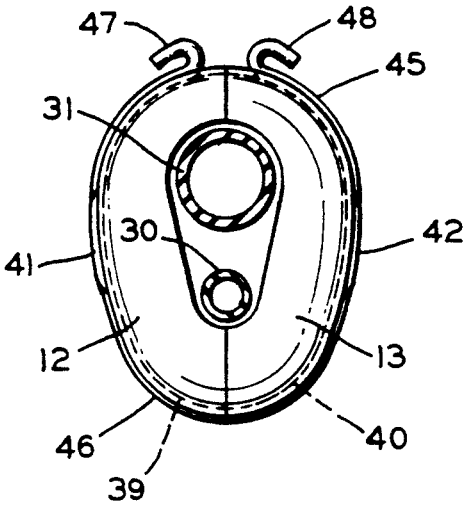
FIG. 6 is a cross sectional view as taken along line 6—6 of FIG. 1.

In attaching the cover halves 12 and 13 to the gun frame 19, the tabs 34 and 35 are inserted into notches 43 on opposite sides of the front end 23 of the frame body 20. As shown in FIG. 4, one side of the notches 43 may be closed by the retainer ring 22. By hooking the tabs 34 and 35 into the notches 43, the front end 15 of the cover halves 12 and 13 are secured to the frame 19. The cover halves 12 and 13 are held together and an upper spring clip 44 is expanded and inserted into the groove 38, as shown in FIGS. 1 and 2. The upper spring clip 44 holds the rear ends 16 of the cover halves 12 and 13 together. A lower spring clip 45 also is expanded and placed in the aligned cover grooves 39 and 40 to hold the lower ends 18 of the cover handle portion 17 together, as shown in FIGS. 1, 2 and 6. The ribs 41 and 42 help retain the lower spring clip 45 in the grooves 39 and 40. The tabs 34 and 35 and the two spring clips 44 and 45 eliminate the need for screws to secure the cover halves 12 and 13 together over the gun frame 19, while facilitating removal of the cover halves 12 and 13 for cleaning or replacement. The elimination of screws is particularly useful on tools that have multiple underlying mechanisms which require clearance for their actions.

Figure 5:
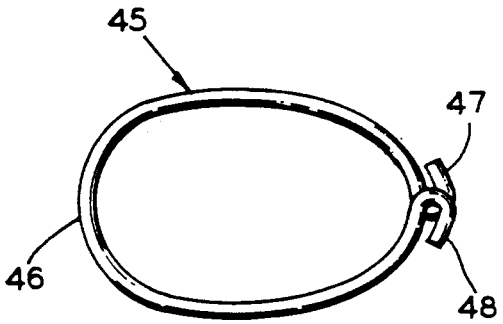
FIG. 5 is a plan view of the lower spring clip for securing the cover to the spray gun.

Details of the lower spring clip 45 are shown in FIGS. 5 and 6. The clip 45 is formed from spring wire which is shaped into a loop 46 which terminates at overlapping looped ends 47 and 48. The loop 46 has the general shape of, but normally is smaller than, the aligned grooves 39 and 40. By separating the ends 47 and 48, the loop 46 may be expanded sufficiently to permit placement of the loop 46 in the aligned grooves 39 and 40. When the ends 47 and 48 are released, the resilient clip 45 contracts to hold the cover halves together.

Figure 7:
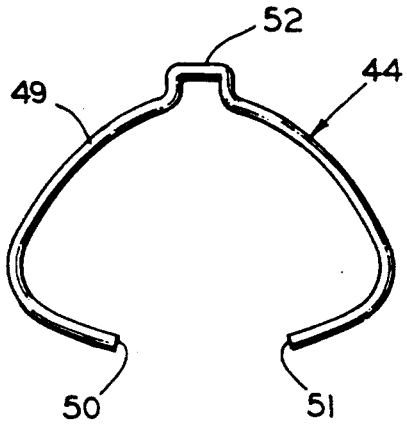
FIG. 7 is a side view of the upper spring clip for securing the cover to the spray gun.
Figure 8:
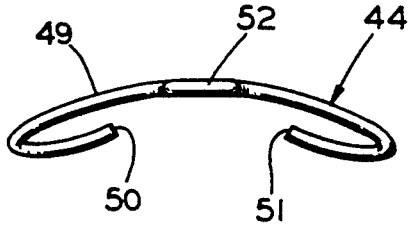
FIG. 8 is a top plan view of the upper spring clip of FIG. 7.

Details of the upper spring clip 44 are shown in FIGS. 7 and 8. The clip 44 is formed from spring wire into a generally C-shaped body 49 which terminates at opposite free ends 50 and 51. The body 49 has the general shape of, but is normally smaller than, the groove 38. A U-shaped bend 52 may be formed in the center of the body 49 to facilitate separating the ends 50 and 51 for placement of the clip in the groove 38. When placed in the groove 38, the clip 44 holds the adjacent portion of the cover halves 12 and 13 together.

Figure 9:
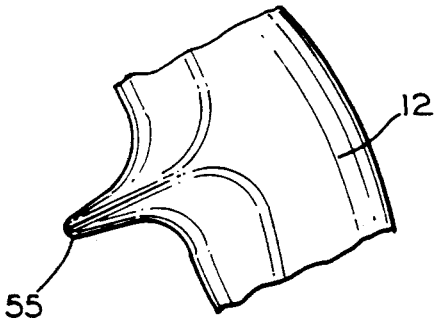
FIG. 9 is a fragmentary side view of a fragmentary portion of a spray gun handle.

Typically, when an operator holds a spray gun in his or her hand, the lower two fingers grasp the gun handle and the upper two fingers grasp and operate the gun trigger. As illustrated in FIG. 1 and 9, a tab 55 projects forward from the gun handle 17 immediately below the path of movement of the trigger 27. The tab 55 positions the lower fingers on the handle 17 so that they do not interfere with trigger movement. For operator comfort, it is important that the cover sections or halves 12 an 13 fit tightly together at the handle 17. Because the cover halves 12 and 13 are secured together only at opposite ends of the handle 17 by the spring clips 44 and 45, it may be necessary to take additional steps to assure that the cover halves 12 and 13 tightly abut in the region of the tab 55. One technique is to mold the edges of the cover halves 12 and 13 slightly convex so that they will be slightly deflected or under stress in the region of the tab 55 when the cover halves are clamped together by the spring clips 44 and 45.

Figure 10:
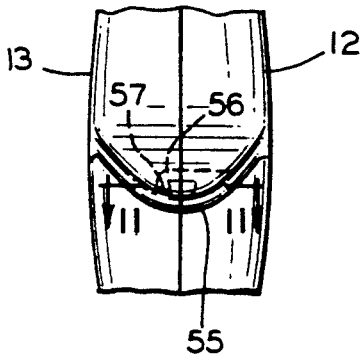
FIG. 10 is a front view of the fragmentary handle portion of FIG. 9.
Figure 11:
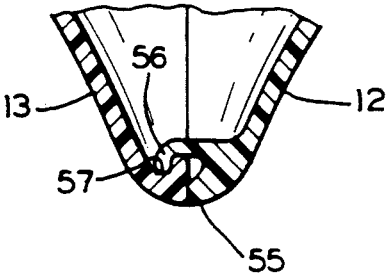
FIG. 11 is a cross sectional view taken along line 11—11 of FIG. 10.
Figure 12:
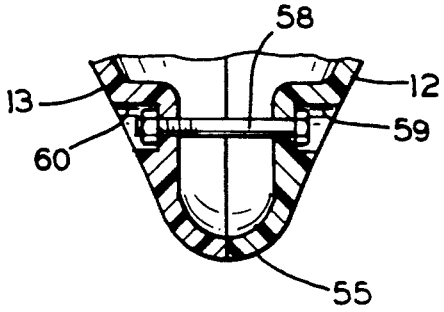
FIG. 12 is a cross sectional view similar to FIG. 11, but showing a modified construction for the spray gun handle.

FIGS. 10 and 11 illustrate a second technique to assure that the cover halves 12 and 13 are held tightly together in the center of the handle 17 and especially adjacent the tab 55. The cover halves 12 and 13 are hollow for receiving the gun frame 19. At the tab 55, a hook 56 is molded on the cover half 12 to project into the cover half 13 and engage a groove 57. When the hook 56 engages the groove 57, the halves 12 and 13 are locked together at the tab 55. FIG. 12 illustrates a further embodiment wherein the cover halves 12 and 13 are secured together adjacent the tab 55 by a screw 58 which is recessed in a stepped hole 59 in the cover half 12 and in a stepped hole 60 in the cover half 13. However, it is preferable to avoid the use of the screw 58 to simplify assembly and disassembly of the cover halves 12 and 13.

It will be appreciated that various modifications and changes may be made to the above described preferred embodiment of an easily removable cover for hand held paint spray guns without departing from the spirit and the scope of the following claims. Although the removable cover was described for and is particularly useful for a paint spray gun, it will be apparent to those skilled in the art that the cover also is adaptable to other gun shaped tools such as pneumatic nailers and staplers. For staplers used to install carpet, for example, the removable cover may be formed from a relatively soft plastic material which will not mar walls and wood trim as the stapler is used to install carpet. Other modifications and uses of the invention within the scope of the claims will be apparent to those skilled in the art.

I claim:

1. A removable cover for a spray gun having a frame including a body and a handle having a free end, said cover comprising first and second cover halves, said cover halves having a shape and size for enclosing at least a portion of the body and the handle of the gun frame when positioned together, each of said cover halves having tab means projecting from a front end portion for engaging a notch on the gun to secure said front end portion of such cover half to the gun, each of said cover halves having a first groove adjacent a rear end portion, first spring retainer clip means for positioning in said first grooves when said cover halves are positioned together for holding said rear end portions together, each of said cover halves having a second groove adjacent a handle end portion of said cover halves, and second spring retainer clip means for positioning in said second grooves when said cover halves are positioned together for holding said handle end portions together.

2. A removable cover for a spray gun, as set forth in claim 1, and wherein said first grooves each have an end which aligns with an end of the other first groove when said cover halves are positioned together, and wherein said second grooves each have an end which aligns with an end of the other second groove when said cover halves are positioned together.

3. A removable cover for a spray gun, as set forth in claim 2, and wherein each second groove has two ends which align with ends of the other second groove when said cover halves are positioned together whereby said second grooves extend completely around said handle end portions.

4. A removable cover for a spray gun, as set forth in claim 3, and wherein each cover half has a pair of ridges formed on the handle end portion for such cover half, and wherein said second groove on each cover half extends between the ridges on such cover half, whereby said ridges help retain said second clip means in said second grooves.

5. A removable cover for a spray gun, as set forth in claim 1, and wherein said first clip means is formed from spring wire and has substantially the shape of at least a portion of said first grooves when said cover halves are positioned together, said first clip means having a size requiring deflection for insertion into said first grooves, and wherein said second clip means is formed from spring wire and has substantially the shape of at least a portion of said second grooves when said cover halves are positioned together, said second clip means having a size requiring deflection for insertion into said second grooves.

6. A paint spray gun including a frame defining a body and a handle having a free end, first and second cover halves enclosing at least a portion of said frame body and handle, each of said cover halves having a tab projecting from a front end portion and engaging a notch on said gun to secure said front end portion of such cover half to said gun, each of said cover halves having a first groove adjacent a rear end portion, a first spring retainer clip positioned in said first grooves, said first clip holding said first end portions of said cover halves together, each of said cover halves having a second groove adjacent a handle end portion of said cover halves, and a second spring retainer clip positioned in said second grooves, said second clip holding said handle end portions together.

7. A paint spray gun, as set forth in claim 6, and further including a fluid head retainer ring secured to a front end of said gun body, and wherein said notches for receiving said cover half tabs are located between said body front end and said retainer ring.

8. A paint spray gun, as set forth in claim 6, and wherein said first grooves each have an end which aligns with an end of the other first groove when said cover halves are positioned together, and wherein said second grooves each have an end which aligns with an end of the other second groove when said cover halves are positioned together.

9. A paint spray gun, as set forth in claim 6, and wherein each cover half has a pair of ridges formed on the handle end portion for such cover half, and wherein said second groove on each cover half extends between the ridges on such cover half, said ridges retaining said second clip in said second grooves.

10. A removable cover for a gun shaped tool having a body and a handle extending from the body, said cover comprising first and second cover halves, said cover halves having a shape and size for enclosing at least a portion of the tool body and handle when said halves are positioned together, each of said cover halves having tab means projecting from a front end portion for engaging a notch on the tool for securing said front end portions of said cover to the tool, each of said cover halves having a first groove adjacent a rear portion and a second groove adjacent a handle end portion, first spring clip means positioned in said first grooves for securing said rear portions together, and second spring clip means positioned in said second grooves for securing together said handle end portions.

11. A removable cover for a gun shaped tool ,as set forth in claim 10, and wherein said first grooves each have an end which aligns with an end of the other first groove when said cover halves are positioned together, and wherein said second grooves each have an end which aligns with an end of the other second groove when said cover halves are positioned together.

12. A removable cover for a gun shaped tool, as set forth in claim 11, and wherein said first clip means is formed from spring wire and has substantially the shape of at least a portion of said first grooves when said cover halves are positioned together, said first clip means having a size requiring deflection for insertion into said first grooves, and wherein said second clip means is formed from spring wire and has substantially the shape of at least a portion of said second grooves when said cover halves are positioned together, said second clip means having a size requiring deflection for insertion into said second grooves.

13. A method for securing a cover to a spray gun comprising the steps of:

a) forming two cover halves with each half having a tab projecting from a front end portion, a first groove extending around at least a portion of a rear end portion and a second groove extending around at least a portion of a handle end portion, said cover halves being sized and shaped to fit together over said spray gun;

b) positioning one cover half on said spray gun with said tab on such cover half inserted into a notch on said spray gun;

c) positioning the other cover half on said spray gun with said tab on such cover half inserted into a second notch on said spray gun;

d) inserting a first spring retainer clip in at least a portion of said first grooves to hold together said rear end portions of said cover halves; and e) inserting a second spring retainer clip in at least a portion of said second grooves to hold together said handle end portions of said cover halves.

14. A method for securing a cover to a spray gun, as set forth in claim 13, and wherein said cover halves are formed with said first grooves each having an end which aligns with an end of the first groove in the other cover half when said cover halves are positioned together, and said second grooves each having an end which aligns with an end of the second groove in the other cover half when said cover halves are positioned together.

15. A method for securing a cover to a spray gun, as set forth in claim 13, and further including the step of forming a pair of ridges on each cover half on opposite sides of said second groove for retaining said second clip in said second grooves.

* * * * *